US005927102A

United States Patent [19]

Matsuo et al.

[11] Patent Number: 5,927,102

[45] Date of Patent: Jul. 27, 1999

[54] RECEIVER-INTEGRATED CONDENSER FOR REFRIGERATING SYSTEM

[75] Inventors: Hiroki Matsuo; Tetsuji Nobuta, both of Kariya, Japan

[73] Assignee: Denso Corporation

[21] Appl. No.: 08/958,573

[22] Filed: Oct. 28, 1997

[30] Foreign Application Priority Data

Oct. 30, 1996 [JP] Japan ..... 8-288804

[51] Int. Cl.[6] ..... F25B 39/04

[52] U.S. Cl. ..... 62/509

[58] Field of Search ..... 62/509, 474; 165/132, 165/173

[56] References Cited

U.S. PATENT DOCUMENTS 5,159,821 11/1992 Nakamura .
5,224,358 7/1993 Yamanaka et al. .
5,228,315 7/1993 Nagasaka et al. .
5,546,761 8/1996 Matsuo et al. .

FOREIGN PATENT DOCUMENTS

A-3-87572 4/1991 Japan .
A-6-94330 4/1994 Japan .

*Primary Examiner*—William Doerrler
*Attorney, Agent, or Firm*—Harness, Dickey & Pierce, PLC

[57] ABSTRACT

A receiver-integrated condenser for a refrigerating system for use in an automotive vehicle is disclosed. The condenser is composed of a heat exchanging core having many tubes extending horizontally in which refrigerant is cooled down and condensed, a pair of header tanks elongated vertically and connected to both ends of the tubes, and a refrigerant receiver for reserving liquid refrigerant therein integrally connected to one of the header tanks which has an inlet joint for receiving overheated refrigerant from a compressor. The inner space of the header tank to which the receiver is connected is divided by a separator into an upper space for receiving the overheated refrigerant and a lower space for receiving refrigerant cooled down in the heat exchanging core. The receiver is connected integrally to the header tank so that it does not overlap with the upper space of the header tank in order to minimize heat transfer from the upper space to the receiver. Thus, the liquid refrigerant reserved in the receiver does not evaporate therein, and a whole space of the receiver is utilized for reserving the liquid refrigerant therein, enabling to fill additional refrigerant in the system without causing a sub-cool temperature rise.

5 Claims, 6 Drawing Sheets

FIG. 3A
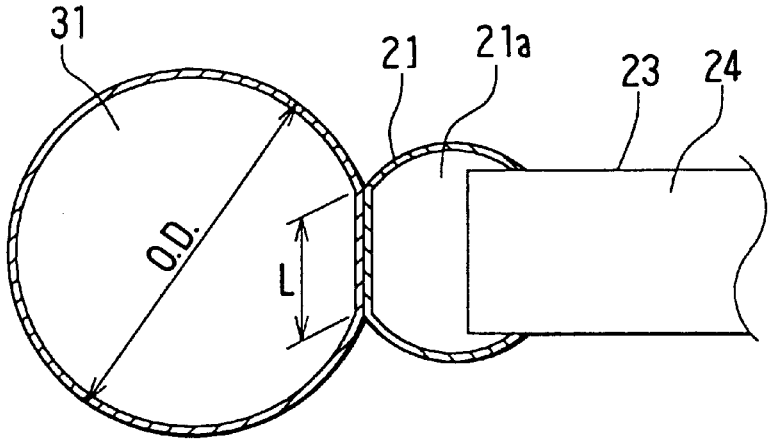
FIG. 3B
CONTACTING AREA OF 1ST HEADER TANK & RECEIVER
| | |
|---|---|
| $S_1$ | 720mm² |
| $S_2$ | 288 |
| $S_3$ | 144 |
| $S_4$ | 0 |
FIG. 3C
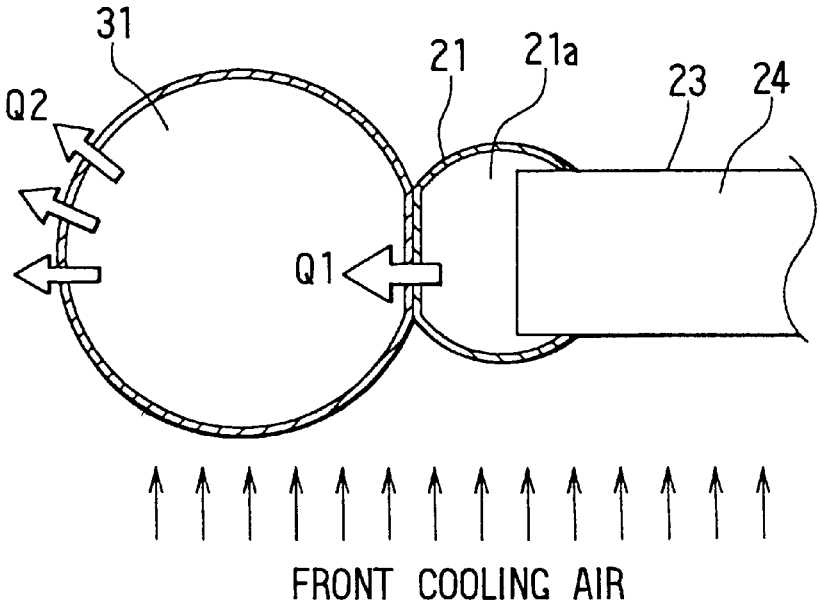

RECEIVER-INTEGRATED CONDENSER FOR REFRIGERATING SYSTEM

CROSS-REFERENCE TO RELATED APPLICATION

This application is based upon and claims benefit of priority of Japanese Patent Application No. Hei-8-288804 filed on Oct. 30, 1996, the content of which is incorporated herein by reference.

BACKGROUND OF THE INVENTION

1. Field of the Invention

The present invention relates to a condenser, to which a receiver for separating and reserving refrigerant is integrally mounted, for a refrigerating system for use in an automotive vehicle.

2. Description of Related Art

Refrigerating systems for a vehicle in which a refrigerant receiver is integrally mounted on a condenser to save a mounting space have been proposed hitherto. This type of a refrigerating system is disclosed, for example, in U.S. Pat. No. 5,546,761. A condenser used in this type of the refrigerating system is a condenser generally called a multi-flow type condenser. The condenser is generally composed of a pair of header tanks and a core having a plurality of tubes, through which refrigerant flows, disposed horizontally between both header tanks. A refrigerant inlet joint is disposed at an upper portion of one of the header tanks (a first header tank), and a refrigerant outlet joint is disposed at a lower portion of the same header tank. Separators are disposed in each header tank to divide a space in the header tank into plural spaces, so that the refrigerant flowing in from the inlet joint flows through the tubes of the core in a serpentine fashion and flows out from the outlet joint. A refrigerant receiver is attached to the other header tank (a second header tank) on which the inlet and outlet joints are not disposed. The second header tank and the receiver communicate with each other through a first communicating hole formed at a lower portion of the second header tank. The refrigerant condensed in the core flows into the receiver tank through the first communicating hole and is separated into gas and liquid portions therein. A second communicating hole is formed at a position lower than the first communicating hole, the first and second communicating holes being separated by a separator in the second header tank. The liquid refrigerant in the receiver flows into the second header tank through the second communicating hole and further flows into a sub-cool portion of the core where the liquid refrigerant is sub-cooled. Then, the sub-cooled liquid refrigerant flows out from the outlet joint disposed at a lower portion of the first header tank.

In the condenser exemplified above, both of the inlet and outlet joints are disposed on the first header tank, and the receiver is integrated with the second header tank. However, it becomes difficult sometimes to dispose both of the inlet and outlet joints on the same header tank in order to meet a specific layout requirement of conduits and pipes for the refrigerating system in an engine compartment.

SUMMARY OF THE INVENTION

The present invention has been made in view of the above-mentioned problem, and an object of the present invention is to provide a receiver-integrated condenser for a refrigerating system which is able to meet a specific layout requirement in an engine compartment, and more particularly to provide a receiver-integrated condenser in which inlet and outlet joints are disposed on respective header tanks (the inlet joint on the first header tank and the outlet joint on the second header tank), and a receiver is integrated with the header tank which has the inlet joint (the first header tank). Further, a proper amount of the refrigerant has to be filled into the refrigerating system having the receiver-integrated condenser which has the structure mentioned above. The present invention provides a receiver structure in which a proper amount of the refrigerant can be filled while keeping a refrigerant sub-cool constant.

In the receiver-integrated condenser according to the present invention, a first and a second header tank are connected to both ends of a heat exchanging core so that refrigerant flowing through the heat exchanging core flows into the header tanks and flows out therefrom. At the top portion of the first header tank, an inlet joint from which overheated refrigerant sent from a compressor flows in is disposed. An outlet joint from which refrigerant condensed in the heat exchanging core flows out is disposed at the bottom portion of the second header tank. An inner space of the first header tank is divided by a separator into two spaces, that is, an upper space into which the overheated refrigerant flows in and a lower space into which the refrigerant cooled down in the heat exchanging core flows in. A refrigerant receiver is connected to the first header tank by soldering at a position where heat of the overheated refrigerant in the upper space of the first header tank does not exceedingly transferred to the receiver. More particularly, the receiver is positioned not to overlap with the upper space of the first header tank in excess of 10 mm.

Since excessive heat is not transferred to the receiver from the upper space of the first header tank, liquid refrigerant stored in the receiver does not evaporate therein. Therefore, a whole space of the receiver can be used as a space for reserving liquid refrigerant therein, and accordingly additional refrigerant to compensate a possible loss of the refrigerant caused by its leakage from the refrigerant system can be filled in the system without adversely affecting the operation of the system. More particularly, the additional refrigerant can be filled, while keeping the sub-cool temperature constant.

It is preferable to connect the receiver to the first header tank so that no portion of the receiver overlaps with the upper space of the first header tank in order to enhance the effect of preventing the heat transfer. Further, it is preferable to divide the heat exchanging core into two portions, that is, an upper portion serving as a refrigerant condensing portion and a lower portion serving as a sub-cool portion for further cool down of the liquid refrigerant.

Other objects and features of the present invention will become more readily apparent from a better understanding of the preferred embodiments described below with reference to the following drawings.

BRIEF DESCRIPTION OF THE DRAWINGS

FIG. 3A is a cross-sectional view showing a contacting dimension of a first header tank and a receiver;

FIG. 3B is a table showing various contacting areas of the first header tank and the receiver corresponding to the structure shown in FIGS. 2A~2D;

FIG. 3C is a cross-sectional view showing a junction of the first header tank and the receiver for explaining heat transfer to and from the receiver;

DETAILED DESCRIPTION OF THE PREFERRED EMBODIMENTS

Figure 1:
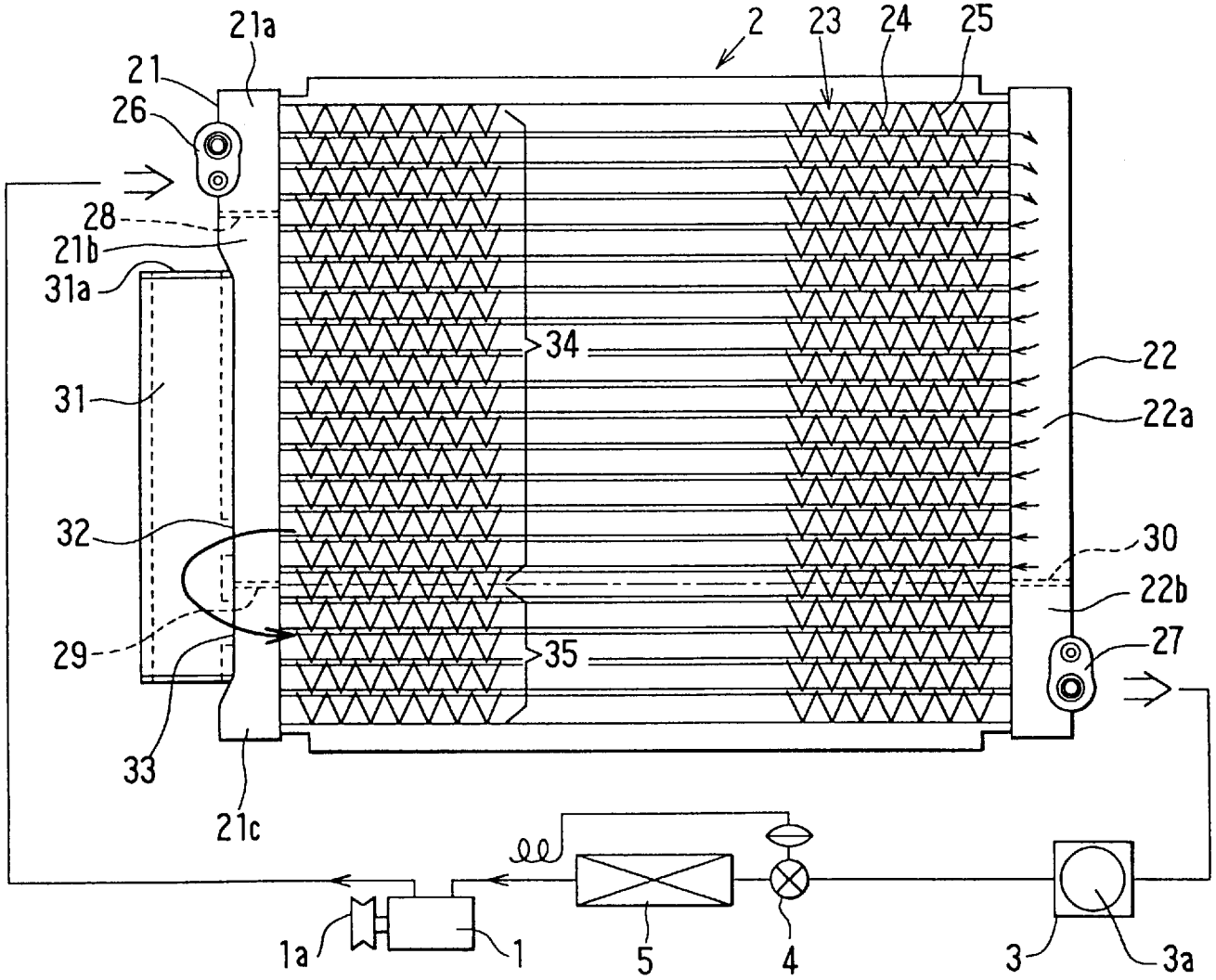
FIG. 1 is a plan view showing a receiver-integrated condenser as a first embodiment according to the present invention, together with conceptual views of other components constituting a refrigerating system.

Referring to FIG. 1, a first embodiment of the present invention will be described. FIG. 1 shows a receiver-integrated condenser 2 together with other components used in a refrigerating system for use in an automotive vehicle. The refrigerating system is composed of a compressor 1 for compressing refrigerant, a receiver-integrated condenser 2, a sight glass 3, a temperature responsive expansion valve 4, an evaporator 5, and a piping connecting these components for constituting a closed refrigerating circuit.

The compressor 1 is mounted in an engine compartment and driven by an engine through a driving belt and an electromagnetic clutch 1*a*. When the electromagnetic clutch 1*a* is energized, the compressor 1 is driven by the engine, sucking refrigerant therein from the evaporator 5 and compressing the refrigerant. The compressed refrigerant in a high pressure and a high temperature is supplied to the receiver-integrated condenser 2. The receiver-integrated condenser 2 is composed of a pair of header tanks, a first and a second header tank 21 and 22, each having a substantially cylindrical shape, a heat exchanging core 23 disposed between the pair of header tanks, and a receiver 31 mounted on the first header tank 21. The condenser shown here is generally called a multi-flow type condenser. The heat exchanging core 23 consists of a plurality of flat tubes 24 disposed horizontally between the first and the second header tanks 21 and 22, and corrugated fins 25 disposed between the flat tubes 24 in heat transferring relation. One end of the flat tubes 24 is connected to the first header tank 21 and the other end to the second header tank 22. A refrigerant inlet joint 26 is disposed at an upper portion of the first header tank 21, and a refrigerant outlet joint 27 is disposed at a lower end of the second header tank 22.

In this embodiment, a first separator 28 and a second separator 29 are disposed in the first header tank 21, and a third separator 30 is disposed in the second header tank 22. A space in the first header tank 21 is divided by the first and the second separator 28 and 29 into three spaces 21*a*, 21*b* and 21*c*. A space in the second header tank 22 is divided by the third separator 30 into two spaces 22*a* and 22*b*. The refrigerant flowing from the inlet joint 26 flows between the first header tank 21 and the second header tank 22 through the flat tubes 24 in a serpentine fashion. The second separator 29 in the first header tank 21 and the third separator 30 in the second header tank 22 are disposed at an equal level. The receiver 31 having a substantially cylindrical shape is connected to the first header tank 21 by soldering at a position lower than the inlet joint 26. Components and parts of the receiver-integrated condenser 2 in the present embodiment are all made of aluminum and integrally connected by soldering.

A space in the receiver 31 communicates with the intermediate space 21*b* of the first header tank 21 through a first communicating hole 32 formed at a little upward position from the second separator 29. The space in the receiver 31 also communicates with the lower space 21*c* of the first header tank 21 through a second communicating hole 33 formed at a little downward position from the second separator 29. The first separator 28 is disposed at a position higher than an upper surface 31*a* of the receiver 31 in this first embodiment. An upper part of the heat exchanging core 23 above the second and third separators 29 and 30 constitutes a condensing portion 34 in which the refrigerant sent from the compressor 1 is cooled down and condensed by cooling air flowing through the heat exchanging core 23. The cooling air is blown by a cooling fan (not shown in the drawing) driven by the engine. A lower part of the heat exchanging core 23 below the second and the third separator 29 and 30 constitutes a sub-cool portion 35 in which liquid refrigerant separated in the receiver 31 is further cooled down by exchanging heat with the cooling air. In other words, the receiver-integrated condenser 2 of the present embodiment is composed of the condensing portion 34, the sub-cool portion 35 and the receiver 35, all integrated in a single body. Incidentally, a desiccant (not shown in the drawing) for absorbing water in the refrigerant is disposed in the receiver 31. A boundary of gas and liquid refrigerant in the receiver 31 is located at an intermediate level between the second separator 29 and the top surface 31*a* of the receiver 31 when the amount of refrigerant filled in the system is normal.

The receiver-integrated condenser 2 is usually mounted on the front most position of a vehicle (in front of a radiator), and is cooled down by a cooling fan which is common to the radiator. The sight glass 3 having a sight window 3*a* is a device for checking whether the amount of the refrigerant filled in the system is normal or not by observing a condition of gas-and-liquid mixed refrigerant which is cooled down in the sub-cool portion 35 of the heat exchanging core 23 and flows out from the outlet joint 27. The sight glass 3 is mounted on a position in the engine compartment where it can be easily observed, for example, at a position in a refrigerant piping close to the receiver-integrated condenser 2. The sight window 3*a* is hermetically mounted on the sight glass 3. If some bubbles in the refrigerant are observed through the sight window, it is judged that the amount of the refrigerant filled in the system is not enough. If no bubbles are observed, it is judged that the amount of the refrigerant is normal.

The temperature responsive expansion valve 4 is installed at a neighborhood of an inlet port of the evaporator 5. It is a device for adiabatically expanding the refrigerant having high temperature and high pressure and converting it to mist of gas-and-liquid mixed refrigerant having low temperature and low pressure. An opening degree of the temperature responsive expansion valve 4 is automatically controlled so that the temperature of the refrigerant at an outlet port of the evaporator 5 is kept at a predetermined level. The evaporator 5 is connected between the temperature responsive expansion valve 4 and the compressor 1. The refrigerant mist, mixture of gas-and-liquid refrigerant, is supplied to the evaporator 5 from the expansion valve 4 and evaporated therein by exchanging heat with air from the outside or inside of the vehicle supplied by a blower (not shown in the drawing) of an airconditioner. A passenger compartment of the vehicle is airconditioned by latent heat of the refrigerant evaporated in the evaporator 5. The evaporator 5 is installed in an airconditioning unit in the passenger compartment.

Now, the operation of the refrigerating system will be described. As the engine of the vehicle is started, and the refrigerating system is turned on, the electromagnetic clutch 1*a* of the compressor 1 is energized. The compressor 1 is driven, and the refrigerant is compressed therein. The compressed and hot refrigerant is supplied from the compressor 1 to the upper space 21*a* of the first header tank 21 through the inlet joint 26. Then, the refrigerant flows through the upper tubes 24 in the condensing portion 34 of the core 23 and enters into the upper space 22*a* of the second header tank 22. The refrigerant, making an U turn in the space 22*a*, flows through the lower tubes 24 and enters into the intermediate space 21*b* of the first header tank 21. During the course of the flow through the tubes in the condensing portion 34, the refrigerant is cooled down by exchanging heat with the cooling air, and becomes saturated liquid refrigerant which partially includes gaseous refrigerant. The saturated liquid refrigerant enters into the receiver 31 through the first communicating hole 32. In the receiver 31, the refrigerant is separated into gaseous and liquid portions and reserved therein. Then, the liquid refrigerant in the receiver 31 enters into the lower space 21*c* of the first header tank 21 through the second communicating hole 33, and flows through the tubes 24 in the sub-cool portion 35. During the course of the flow, the liquid refrigerant is further cooled down (sub-cooled). The sub-cooled liquid refrigerant enters into the lower space 22*b* of the second header tank 22 and flows out from the outlet joint 27. The sub-cooled liquid refrigerant is supplied to the temperature responsive expansion valve 4 through the sight glass 3. The sub-cooled liquid refrigerant is expanded by the expansion valve 4 and converted into the gas-and-liquid mixed refrigerant mist having low temperature and low pressure. Then, the refrigerant mist is evaporated in the evaporator 5 by absorbing heat from air which in turn cools down the passenger compartment. The hot gaseous refrigerant evaporated in the evaporator 5 is sucked into the compressor 1 in which the refrigerant is again compressed.

Figure 2A:
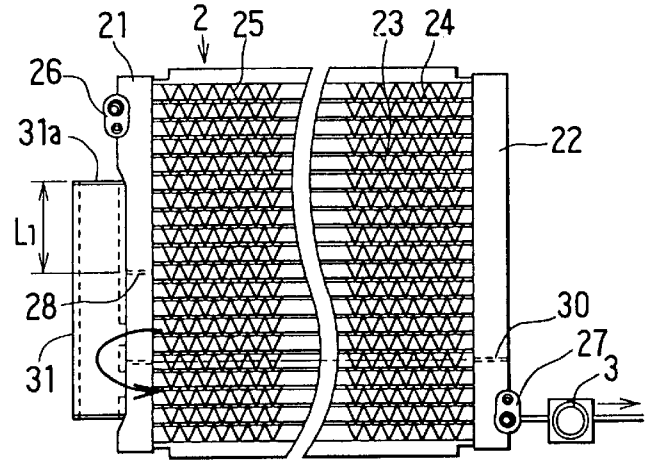
FIGS. 2A~2D are plan views showing receiver-integrated condensers in which separators in header tanks are disposed in various positions.
Figure 2B:
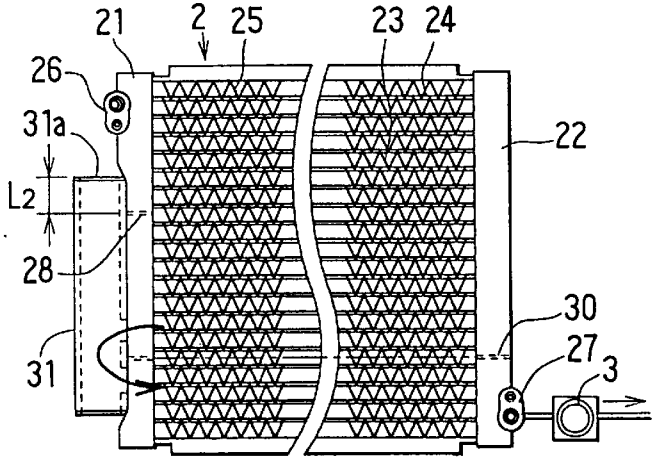
Figure 2C:
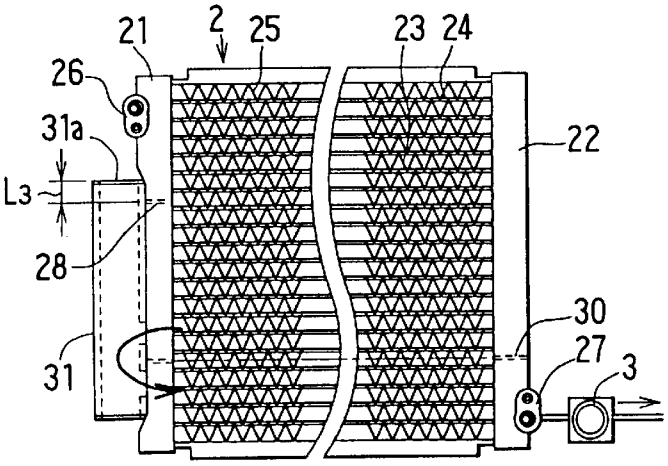

It is found out through various experiments that the position of the first separator 28 is very important to achieve a desired operation of the system and particularly to attain a satisfactory refrigerant filling characteristic. Several prototypes of the receiver-integrated condenser in which the position of the first separator 28 is varied are made. Four examples are shown in FIGS. 2A~2D in which the position of the first separator 28 is measured from the top surface 31*a* of the receiver 31. The separator position L1 of the prototype shown in FIG. 2A is 50 mm, L2 in FIG. 2B is 20 mm, and L3 in FIG. 2C is 10 mm. The separator 28 in the prototype shown in FIG. 2D, which is the same as the first embodiment described above, is disposed at a position 20 mm above the top surface 31*a* of the receiver 31.

Figure 4:
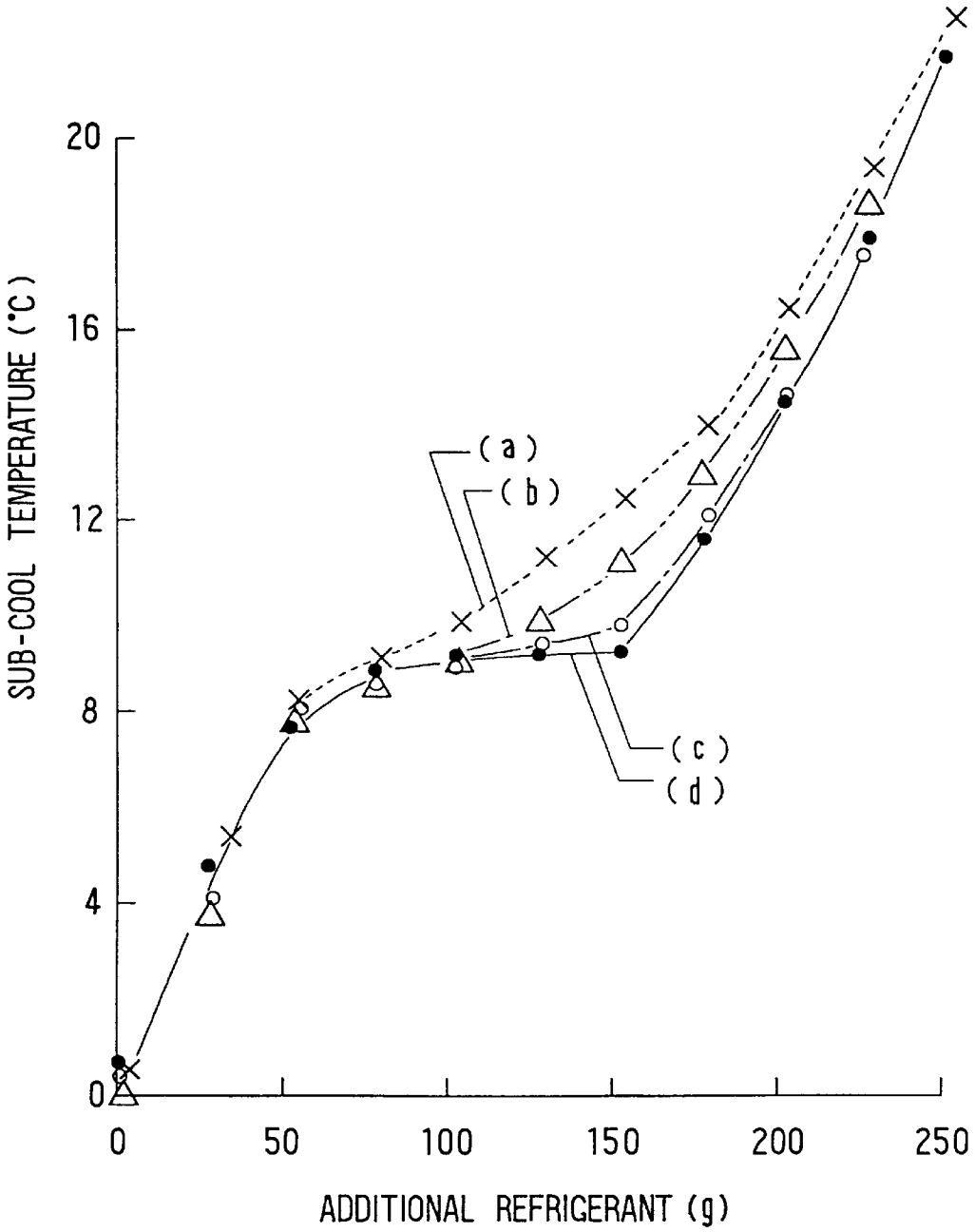
FIG. 4 is a graph showing a refrigerant filling characteristic.

In the prototype shown in FIG. 2A, the first separator 28 of which is positioned at L1=50 mm, the refrigerant cannot be filled in the refrigerating system with a satisfactory characteristic as explained below. The refrigerant filling characteristic is shown in FIG. 4 in which sub-cool temperature is plotted on the ordinate versus additional amount (explained below) of refrigerant on the abscissa. Generally, in the refrigerating system for use in an vehicle, some amount of refrigerant, for example, about 100 grams, is additionally filled in the system after bubbles in the refrigerant have not been observed through the sight glass 3 in a filling process, so that the cooling ability does not decrease when some of the refrigerant leaks out from the system. The additional amount of the refrigerant is set in a range from 50 to 150 grams, taking into account variation in the filling process. A graph (a) in FIG. 4 shows a refrigerant filling characteristic of the prototype shown in FIG. 2A. Graphs in FIG. 4 are plotted under the following conditions: an air-conditioner blower is set at HIGH (amount of air is 450 $m^3$/hr), ambient temperature is 30° C., and an engine is idling (750 rpm). As seen from the graph (a), the sub-cool temperature rises continuously in the range of additional refrigerant amount from 50 grams to 150 grams. In this range, it is highly desirable that the sub-cool temperature be kept constant in order to prevent pressure increase in the system and to prevent increase of compressor load. This means that the prototype shown in FIG. 2A does not satisfy a requirement for the refrigerant filling characteristic.

The reason why the sub-cool temperature rises in the filling process of the additional refrigerant in the prototype shown in FIG. 2A can be explained as follows. The receiver 31 has a function to reserve excessive refrigerant in the system therein to compensate refrigerant leakage from the system. Therefore, it is originally designed so that the operation of refrigerating cycle is not affected by the liquid refrigerant level in the receiver 31 until it is completely filled. In the prototype shown in FIG. 2A, because the first separator 28 is disposed below the top surface 31*a* of the receiver 31 by the dimension L1 (50 mm), the upper space 21*a* of the first header tank 21 overlaps with the receiver 31 in the dimension L1. The temperature of the upper space 21*a* is high because the high temperature gaseous refrigerant flows into the upper space 21*a* from the inlet joint 26. Heat is easily transferred from the upper space 21*a* to the overlapped receiver 31 because these components are all made of a heat conductive material such as aluminum. Therefore, the receiver 31 is heated.

Figure 6:
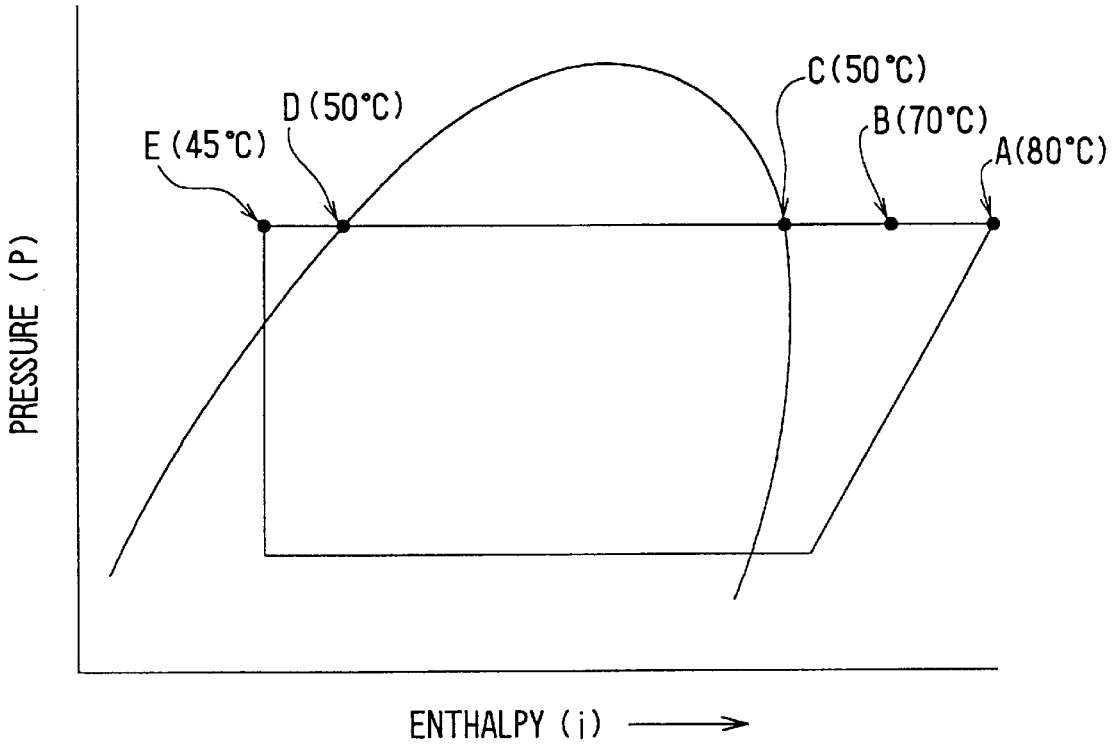
FIG. 6 is a Mollier diagram showing an operation in a refrigerating system.

The state of the refrigerant in the upper space 21*a* and in the receiver 31 is shown in a Mollier diagram in FIG. 6.

The state of the hot gaseous refrigerant in the upper space 21*a* is indicated with a point A in the diagram (for example, its temperature is 80° C.), and the state of the saturated refrigerant in the receiver 31 is indicated with a point D (for example, its temperature is 50° C.). Incidentally, points B and C indicate the state of the refrigerant in the course of the condensing portion 34, and a point E indicates that of the outlet of the sub-cool portion 35. As the additional refrigerant is filled in the system, a liquid refrigerant level in the receiver 31 goes up gradually and exceeds the position of the first separator 28. In this situation, the refrigerant in the receiver 31 is heated and evaporated in the receiver. Therefore, it is difficult for the liquid refrigerant to increase its level in the receiver 31. In other words, the space above the first separator 28 in the receiver 31 cannot be used as a space for reserving the refrigerant, and accordingly the additional liquid refrigerant filled after the liquid level of the refrigerant in the receiver 31 has reached the position of the first separator 28 overflows into the core 23. It has been found out that the filling characteristic (a) shown in FIG. 4 corresponds to the phenomenon mentioned above.

Another prototype of the receiver-integrated condenser shown in FIG. 2B has the first separator 28 at a position L2=20 mm, as mentioned above. The refrigerant filling characteristic of this prototype is shown as graph (b) in FIG. 4. As seen from the graph, the sub-cool temperature in the range of the additional refrigerant 50–150 grams increases gradually though the temperature increase is alleviated, compared with the graph (a) for the prototype of FIG. 2A.

The receiver-integrated condenser shown in FIG. 2C has the first separator 28 at a position L3=10 mm. Its filling characteristic is shown as graph (c) in FIG. 4. It is seen from the graph that the sub-cool temperature rise during the filling range of 50–150 grams is very small. This is because the receiver 31 overlaps with the hot upper space 21*a* only in a distance of 10 mm. Judging from the filling characteristic, the receiver-integrated condenser shown in FIG. 2C can be used without any practical problem. Therefore, this is selected as a second embodiment according to the present invention.

Figure 2D:
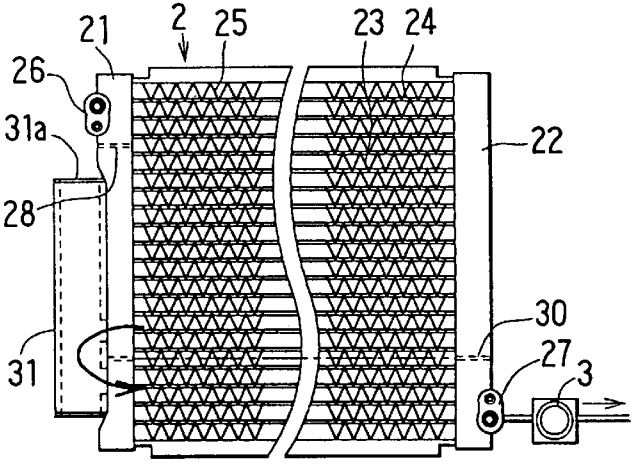

The receiver-integrated condenser shown in FIG. 2D is the same as the first embodiment described above in which the first separator 28 is disposed 20 mm above the top surface 31*a* of the receiver 31. Its filling characteristic is shown as graph (d) in FIG. 4. As seen from the graph, the additional refrigerant of 50–150 grams can be filled without giving no affect on the sub-cool temperature.

Some more details as to the contacting area of the first header tank 21 and the receiver 31 and heat transfer therebetween will be described referring to FIGS. 3A, 3B and 3C. FIG. 3A is a cross-sectional view showing the contact of the receiver 31 with the first header tank 21 which is common to all of the embodiments and samples shown in FIGS. 2A~2D.

The receiver 31 having an outer diameter (OD=34.7 mm) and the first header tank 21 are connected by soldering and contact each other in a distance (L=14.4 mm). FIG. 3B shows contacting areas S1~S4 corresponding to the receiver-integrated condensers shown in FIGS. 2A~2D, respectively. FIG. 3C shows a heat balance in the receiver 31. Heat Q1 is transferred to the receiver 31 from the upper space 21*a* of the first header tank 21 through the contacting area shown in FIG. 3B, and heat Q2 is radiated outside from the receiver 31 and cooled down by cooling air from the front. The larger the contacting area (S1~S4) is, the larger amount of heat Q1 is transferred to the receiver 31 from the upper space 21*a*. In the second embodiment shown in FIG. 2C which has contacting area S3 (S3=144 $mm^2$), Q1 and Q2 are almost balanced (Q1≈Q2). This is reflected in the refrigerant filling characteristic graph (c) in FIG. 4.

Figure 5:
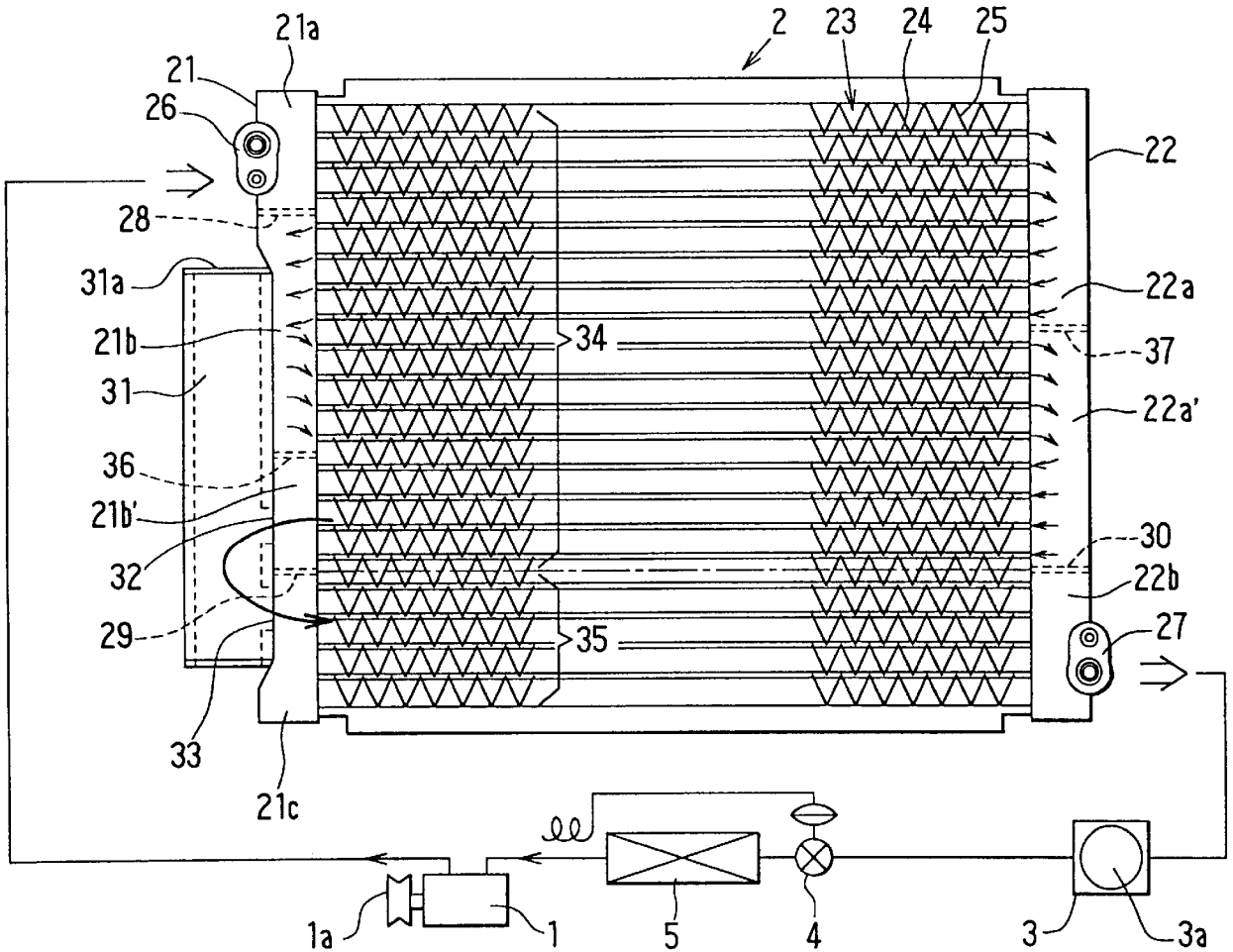
FIG. 5 is a plan view showing a receiver-integrated condenser as a third embodiment according to the present invention, together with conceptual views of other components constituting a refrigerating system.

A third embodiment according to the present invention is shown in FIG. 5. In this embodiment, another separator 36 is added to the first and second separators 28 and 29 in the first header tank 21 of the foregoing embodiments, and one more separator 37 is added to the third separator 30 in the second header tank 22 of the foregoing embodiments. The separator 36 is disposed at a position between the first and second separators 28 and 29. The separator 37 in the second header tank 22 is disposed at a position corresponding to an intermediate position between the separators 28 and 36 in the first header tank 21. By adding the separator 36 in the first header tank 21, the intermediate space in the first header tank 21 is divided into two spaces 21*b* and 21*b*'. Also, the upper space of the second header tank 22 is divided into two spaces 22*a* and 22*a*' by the added separator 37. Because the condensing portion 34 of the third embodiment is further divided by the additional separators, the refrigerant makes more turns in the condensing portion 34.

The sub-cool portion 35 of the heat exchanging core 23 in the foregoing embodiments may be disposed separately from the condensing portion 34. In this case, the outlet joint 27 of the second header tank 22 is eliminated, and an outlet joint is disposed on the receiver 31. The outlet joint on the receiver is connected to a separately disposed sub-cool portion through a piping. It is also possible to apply the present invention to the system which has no sub-cool portion.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A receiver-integrated condenser for a refrigerating system comprising:

a heat exchanging core having a plurality of tubes disposed horizontally for cooling refrigerant flowing therethrough;

a first header tank extending vertically at one end of the plurality of tubes, the first header tank being connected to the plurality of tubes so that the refrigerant communicates therebetween;

a second header tank extending vertically at the other end of the plurality of tubes, the second header tank being connected to the plurality of tubes so that the refrigerant communicates therebetween; and a receiver, in a vertically extended shape having a top surface and a bottom surface, for reserving liquid refrigerant therein connected integrally with the first header tank, wherein:

the first header tank is divided into an upper space and a lower space by a first separator, an inlet joint for introducing overheated refrigerant being disposed in the upper space;

an inner space of the receiver is connected to the lower space of the first header tank through a first communicating hole so that the refrigerant communicates therebetween; and the first separator is disposed in the first header tank at a position which is higher than a position 10 mm below the top surface of the receiver.

2. A receiver-integrated condenser for a refrigerating system according to claim 1, wherein the first separator is disposed in the first header tank at a position higher than the top surface of the receiver.

3. A receiver-integrated condenser for a refrigerating system comprising:

a heat exchanging core having a plurality of tubes disposed horizontally for cooling refrigerant flowing therethrough;

a first header tank extending vertically at one end of the plurality of tubes, the first header tank being connected to the plurality of tubes so that the refrigerant communicates therebetween;

a second header tank extending vertically at the other end of the plurality of tubes, the second header tank being connected to the plurality of tubes so that the refrigerant communicates therebetween; and a receiver, in a vertically extended shape having a top surface and a bottom surface, for reserving liquid refrigerant therein connected integrally with the first header tank, wherein:

the first header tank is divided into an upper space and a lower space by a first separator, an inlet joint for introducing overheated refrigerant being disposed in the upper space;

an inner space of the receiver is connected to the lower space of the first header tank through a first communicating hole so that the refrigerant communicates therebetween;

the first separator is disposed in the first header tank at a position which is higher than a position 10 mm below the top surface of the receiver;

a second separator is disposed in the lower space of the first header tank, the second separator dividing the lower space into an intermediate space and a bottom space;

the inner space of the receiver is connected to the bottom space through a second communicating hole so that liquid refrigerant in the receiver flows into the bottom space;

a third separator is disposed in the second header tank at a horizontal level equal to the second separator, the third separator dividing an inner space of the second header tank into an upper space and a lower space;

an outlet joint is disposed in the lower space of the second header tank so that the refrigerant flows out therethrough; and a condensing portion, where the refrigerant is cooled down and condensed, is formed in a region higher than a level of the second and third separators in the heat exchanging core, and a sub-cool portion, where liquid refrigerant is sub-cooled, is formed in a region lower than a level of the second and third separators in the heat exchanging core.

4. A refrigerating system for use in an automotive vehicle comprising:

a compressor driven by an engine of the automotive vehicle for compressing refrigerant;

a receiver-integrated condenser for condensing gaseous and overheated refrigerant sent from the compressor;

an expansion valve for expanding liquid refrigerant sent from the receiver-integrated condenser; and an evaporator for evaporating gas-and-liquid mixed refrigerant sent from the expansion valve, wherein:

all of the above are connected in series forming a closed refrigerating circuit; and the receiver-integrated condenser is the one recited in claim 1.

5. A receiver-integrated condenser for a refrigerating system comprising:

a heat exchanging core having a plurality of tubes disposed horizontally for cooling refrigerant flowing therethrough;

a first header tank extending vertically at one end of the plurality of tubes, the first header tank being connected to the plurality of tubes so that the refrigerant communicates there between;

a second header tank extending vertically at the other end of the plurality of tubes, the second header tank being connected to the plurality of tubes so that the refrigerant communicates therebetween; and a receiver, in a vertically extended shape having a top surface and a bottom surface, for reserving liquid refrigerant therein connected integrally with the first header tank, wherein:

the first header tank is divided into an upper space and a lower space by a first separator, an inlet joint for introducing overheated refrigerant being disposed in the upper space;

an inner space of the receiver is connected to the lower space of the first header tank through a first communicating hole so that the refrigerant communicates therebetween; and the first separator is disposed in the first header tank at a position with respect to the top surface of the receiver such that a first amount of heat transferred from the upper space of the first header to the receiver is less than a second amount of heat transferred from the receiver to a surrounding environment.

* * * * *